United States Patent [19]

Miskinis

[11] 4,394,921

[45] Jul. 26, 1983

[54] GLASSWARE STOPPER WITH VENTING VALVE

[76] Inventor: Robert J. Miskinis, 9758 Airport Vista Rd., Santee, Calif. 92071

[21] Appl. No.: 305,166

[22] Filed: Sep. 24, 1981

[51] Int. Cl.[3] ..... B65D 39/16

[52] U.S. Cl. ..... 215/296; 215/314

[58] Field of Search ..... 215/314, 296; 222/520; 251/352, 251; 411/292

[56] References Cited

U.S. PATENT DOCUMENTS

| | | | |
|---|---|---|---|
| 20,843 | 7/1858 | Ewing | 215/314 X |
| 607,019 | 7/1898 | Comer | 222/520 |
| 1,075,523 | 10/1913 | Vaterhaus | 411/292 |
| 1,085,990 | 2/1914 | Morgan | 251/351 X |
| 2,985,180 | 5/1961 | Grayson | 251/351 X |
| 3,059,821 | 10/1962 | Kubiliunas | 222/520 |
| 3,476,278 | 11/1969 | Lollmann | 215/296 |

FOREIGN PATENT DOCUMENTS

| | | | |
|---|---|---|---|
| 294660 | 11/1928 | United Kingdom | 215/314 |

*Primary Examiner*—Donald F. Norton
*Attorney, Agent, or Firm*—George J. Rubens

[57] ABSTRACT

A Teflon stopper for glassware includes a venting valve formed in the stopper with a valve stem threadably mounted within a bore in the stopper for selectively controlling communication between a vent passage within the stopper and a vent passage within the valve stem. An extractor assembly including a threaded portion on the outer end of the stopper and an extractor nut threadably mounted thereon is provided for easy extraction of the stopper from a flask opening.

1 Claim, 4 Drawing Figures

GLASSWARE STOPPER WITH VENTING VALVE

BACKGROUND OF THE INVENTION

The present invention relates to chemistry laboratory equipment and pertains particularly to a novel venting stopper.

Chemical and biological laboratories utilize a great deal of glassware in the form of vessels, flasks, tubing and the like. Tests, experiments, and the like carried out at such laboratories frequently require venting of the contents of a vessel. In the past, such venting has been carried out by loosening the stopper on the vessel and placing it in a position to permit venting or in the alternative, mounting a stop cock in the vessel and venting the vessel by means of the stop cock.

These forms of venting are unsatisfactory where controlled or precise venting is required. It is therefore desirable that some improved means of control venting of laboratory glassware vessels be available.

SUMMARY AND OBJECTS OF THE INVENTION

It is the primary object of the present invention to provide an improved vent stopper for laboratory vessels.

In accordance with the primary aspect of the present invention, a stopper for a laboratory glassware vessel is made of a polymer resin material such as that sold under the trademark Teflon, and includes a vent valve formed therein for controlled venting of a vessel in which the stopper is placed.

BRIEF DESCRIPTION OF THE DRAWINGS

The above and other objects and advantages of the present invention will become apparent from the following description when read in conjunction with the drawings, wherein.

DETAILED DESCRIPTION OF PREFERRED EMBODIMENT

Figure 1:
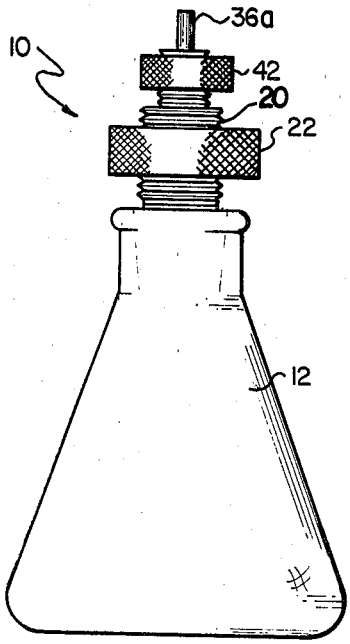
FIG. 1 is a side elevation view of a laboratory flask showing a vent stopper in accordance with the invention in place.

Turning to the drawings, there is illustrated in FIG. 1 a valve in accordance with the invention designated generally by the numeral 10 and shown in position in the open end of a glass laboratory flask.

Figure 2:
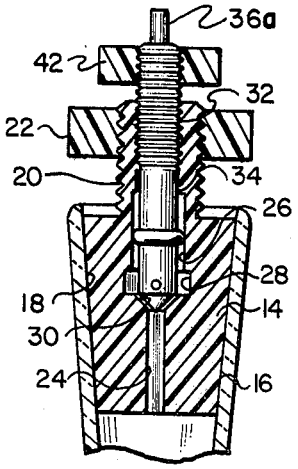
FIG. 2 is a side elevation view in section of the valve of FIG. 1 in the closed position.

The stopper valve assembly includes, as best seen in FIG. 2, a stopper body 14 having a standard taper surface 16 for fitting into the standard taper opening 18 of a vessel or other glass container or connector. The stopper is preferably constructed of a polymer resin such as Teflon, and includes a retractor assembly at the upper end thereof which comprises a threaded cylindrical surface 20 on which is mounted a retractor nut 22 for rotation into engagement with the upper peripheral edge of the flask or connector opening for retracting the stopper from its position within the connection.

The valve assembly of the present invention comprises a first bore or passage 24 formed in the stopper 14 extending substantially coaxially therefrom from the inner end thereof to a point of intersection about midway the length of the stopper with a second bore 26 having a diameter on the order of about 2 to 3 times that of the first bore or passage. An enlarged bore or annular groove 28 is formed at the intersection of the bores 24 and 26, forming a valve chamber therein at this intersection. Also formed at the intersection of the two bores is a valve seat 30 shown in this instance as a tapered surface. Other forms of valve seats may be utilized to serve the purpose. The bore 26 also includes a threaded portion or section thereof at 32 beginning at the outer end thereof extending approximately one-half the length of the bore 26 and terminating at an annular groove 34. The threads 32 may be coarse or fine depending on the requirements of the valve, to be explained.

A valve stem 36 having a generally cylindrical elongated configuration includes a generally conical shaped valve portion 38 formed at the forward end thereof for engagement with the valve seat 30. The tapered valve portion 38 may be varied in configuration to provide either a fine or coarse adjustment for either a quick acting valve with a combination of coarse threads and an obtuse angle nose cone. Alternatively a fine adjustment may be provided with a fine thread portion and a long conical valve tip. Thus variations in the valve can be made for various uses.

The valve stem includes a threaded portion 40 extending along a portion thereof for engagement with the threaded section 32 of the valve body or bore of the stopper. In addition, a control knob 42 may be mounted on the valve stem by means of threads 44 therein and secured in a non-rotatable condition by means of a dowel pin or the like 46 extending in a bore therein. This provides for a simplified construction enabling the use of various configurations for the valve actuating knob 42. Also, the knob 42 is preferably larger in diameter than the threaded portion 20 to retain retractor nut 22 in place to prevent loss thereof.

The valve stem includes a venting passage comprising a cross bore or passage 48 at the forward end thereof adjacent the nose or valve cone thereof and adapted to communicate with the valve chamber 28. A axial bore or passageway 50 extends the full length of the valve body 36 communicating with the cross bore 48 and the outer end of the valve body. An extension **36*a* of the valve body outward beyond the actuating knob 42** permits the attachment of a hose or the like for communicating the vented gas or the like to a selected container or area.

In operation, the valve stopper may be placed in the open mouth of a selected container or in the open end of a glass tube or the like in a laboratory setup. The Teflon stopper provides an effective, non-contaminating seal for most applications. The stopper however, if of a diameter of on the order of about half an inch or more, must include a retractor assembly for retracting and/or extracting the stopper from the connection when desired.

The valve may be closed when the stopper is utilized solely for closing the selected opening. The Teflon valve and stopper combination provides an effective sealing of the vessel or equipment.

Figure 3:
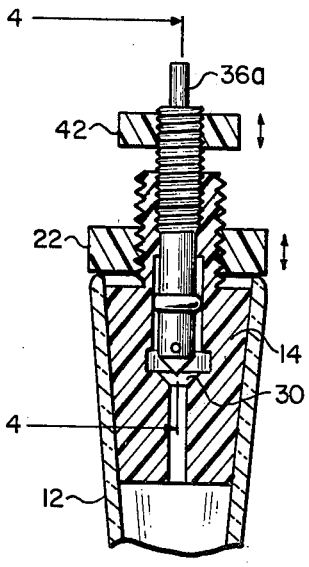
FIG. 3 is a view like FIG. 2 showing the valve in an open position.
Figure 5:
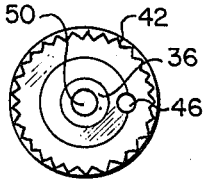
FIG. 5 is a top view of the valve stem of FIG. 4.
Figure 4:
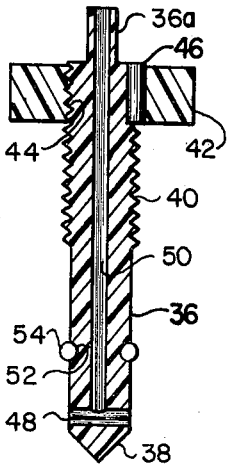
FIG. 4 is a view taken generally on line 4—4 of FIG. 3.

When it is desired to vent the vessel or tubing, the valve stem 36 is rotated simply by grasping the knob 42 and rotating in the counter clockwise direction, resulting in withdrawing the valve stem from the seat as shown in FIG. 3, thereby providing open communication between the passageway 24 within the stopper 14 and the passageway 48, 50 within the valve stem. This provides a controlled venting of the vessel or the like.

While I have illustrated and described my invention by means of specific embodiments, it is to be understood that numerous changes and modifications may be made therein without departing from the spirit and scope of the invention as defined in the appended claims.

Having described my invention, I now claim:

1. A vent stopper for a glassware vessel having a standard taper opening with a tapered surface comprising:

a reusable stopper body (made of a polymer resin) having a diameter less than the diameter of the vessel opening and having a standard taper outer surface to sealably conform to the tapered surface of the vessel, an inner end for extending into the neck of the vessel, and an outer shank end, said shank end having a diameter no greater than the diameter of the stopper body to enable the stopper body to be totally and instantly sealed within the vessel opening below the rim of the vessel opening anywhere along the entire standard taper surface, a first bore extending from said inner end to proximate the center of said stopper body, a second bore extending from said outer end and communicating with said first bore, a valve seat at the intersection of said first and second bores, a valve stem having a passage therein mounted within said second bore and selectively movable into and out of engagement with said seat for selectively blocking and opening communication between said bore and said passage, an extractor assembly for extracting said stopper from the vessel opening by breaking the seal between said standard taper surfaces, said shank end of the stopper being threaded, an extractor nut threadedly mounted on the threaded shank end and having a diameter greater than the diameter of the vessel opening so as to engage the rim of the vessel opening and upon turning exert an axial force on the stopper body to break the seal between said surfaces and allow the stopper to be lifted freely out of the vessel opening.

* * * * *